US008142577B2

(12) United States Patent
Yamasaki et al.

(10) Patent No.: US 8,142,577 B2
(45) Date of Patent: Mar. 27, 2012

(54) HIGH STRENGTH WIRE ROD EXCELLENT IN DRAWABILITY AND METHOD OF PRODUCING SAME

(75) Inventors: Shingo Yamasaki, Kitakyushu (JP); Arata Iso, Kitakyushu (JP); Seiki Nishida, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 11/994,100

(22) PCT Filed: Jun. 29, 2006

(86) PCT No.: PCT/JP2006/313022

§ 371 (c)(1),
(2), (4) Date: Dec. 27, 2007

(87) PCT Pub. No.: WO2007/001054

PCT Pub. Date: Jan. 4, 2007

(65) Prior Publication Data

US 2009/0151824 A1 Jun. 18, 2009

(30) Foreign Application Priority Data

Jun. 29, 2005 (JP) ..... 2005-190258

(51) Int. Cl.
*C21D 9/52* (2006.01)
*C22C 38/00* (2006.01)

(52) U.S. Cl. ..... 148/598; 148/330; 148/595

(58) Field of Classification Search ..... 148/595, 148/598, 330; *B21B 1/16*
See application file for complete search history.

(56) References Cited

U.S. PATENT DOCUMENTS

| | | | |
|---|---|---|---|
| 5,211,772 | A | 5/1993 | Ashida et al. |
| 6,322,641 | B1 | 11/2001 | Makii et al. |
| 2005/0087270 | A1 | 4/2005 | Nagao et al. |

FOREIGN PATENT DOCUMENTS

| | | | |
|---|---|---|---|
| EP | 0 169 587 | | 1/1986 |
| EP | 1577410 | | 9/2005 |
| JP | 04-371549 | | 12/1992 |
| JP | 11-315349 | | 11/1999 |
| JP | 2001-131697 | | 5/2001 |
| JP | 2003-328077 | | 11/2003 |
| JP | 2004-137597 | | 5/2004 |
| JP | 2044-137597 | | 5/2004 |
| JP | 2005-126765 | | 5/2005 |
| WO | WO 2004/029315 | | 4/2004 |
| WO | WO02004029315 | * | 4/2004 |

OTHER PUBLICATIONS

Supplementary European Search Report for associated European Patent Application No. 06767639.5.

R.W. Fountain et al., "Solubility and Precipitation of Boron Nitride in Iron-Boron Alloys" Transactions of The Metallurgical Society of AIME, vol. 224, pp. 599-605 Jun. 1962.

* cited by examiner

*Primary Examiner* — Jessica L Ward
*Assistant Examiner* — Alexander Polyansky
(74) *Attorney, Agent, or Firm* — Dorsey & Whitney LLP

(57) ABSTRACT

A wire rod which is mainly composed of pearlite and has an area fraction of 5% or less of a non-pearlite structure composed of pro-eutectoid ferrite, degenerate-pearlite or bainite in a section, or has an area fraction of 10% or less of a non-pearlite structure in a portion from the surface to a depth of 100 μm.

10 Claims, 2 Drawing Sheets

AREA FRACTION OF PRO-EUTECTOID FERRITE (%)

AREA FRACTION OF PRO-EUTECTOID FERRITE (%)

HIGH STRENGTH WIRE ROD EXCELLENT IN DRAWABILITY AND METHOD OF PRODUCING SAME

TECHNICAL FIELD

The present invention relates to a high strength hot-rolled wire rod excellent in drawability which is drawn and used for PC steel wires, galvanized stranded steel wires, spring steel wires, suspension bridge cables and the like. The invention also relates to a method of producing the wire rod and to a steel wire obtained by drawing the wire rod.

Priority is claimed on Japanese Patent Application No, 2005-190258, filed Jun. 29, 2005, the content of which is incorporated herein by reference.

BACKGROUND ART

In general, high carbon hard wires are produced by subjecting hot-rolled wire rods to a patenting treatment, where necessary, and thereafter drawing the wire rods, thereby obtaining steel wires having a predetermined diameter. By such a treatment, steel wires are required to have a strength of 1600 MPa or more and a sufficient ductility which is, for example, evaluated on the basis of a reduction of area after breaking.

In order to satisfy the above-described requirements, attempts have been made to increase the drawing workability of the high carbon wire rods by controlling segregations or microstructures or by adding particular elements.

A reduction of area of patented wire rods depends on a grain size of austenite. The reduction of area can be improved by refining the grain size of austenite. Thus, attempts have been made to decrease the austenite grain size by using nitrides or carbides of Nb, Ti, B and the like as pinning particles.

A wire rod has been suggested in which as a chemical composition, one or more elements selected from the group consisting of 0.01 to 0.1 wt % of Nb, 0.05 to 0.1 wt % of Zr and 0.02 to 0.5 wt % of Mo, in mass percent, are added to a high carbon wire rod (e.g., Patent Document 1: Japanese Patent No. 2609387).

Another wire rod has been suggested in which NbC is contained in a high carbon wire rod to refine a grain size of austenite (e.g., Patent Document 2: Japanese Unexamined Patent Application, First Publication No. 2001-131697).

DISCLOSE OF THE INVENTION

Problems to be Solved by the Invention

The wire rod described in Patent Document 1 contains the above-described chemical composition so as to have a component composition that increases the ductility of a steel wire. However, since each of the constituent elements added to the wire rod of Patent Document 1 is expensive, there is a possibility of increasing the production cost.

In the wire rod described in Patent Document 2, drawing workability is improved by using NbC as pinning particles. However, since each of the constituent elements added to the wire rod of Patent Document 2 is expensive, there is a possibility of increasing the production cost. In addition, since Nb forms coarse carbides or nitrides and Ti forms coarse oxides, there is a possibility that these coarse particles act as sources of breakage, thereby deteriorating the drawability of the wire rod.

It is confirmed that increasing the content of C and Si in components of steel is the most economical and effective expedient to increase the strength of a high carbon steel wire. However, in accordance with increasing Si content, generation of ferrite is accelerated and precipitation of cementite is suppressed in the steel. Therefore, when the steel is cooled from an austenite region during a patenting treatment, pro-eutectoid ferrites in platy shapes tend to form along the austenite grain boundaries, even in the case of steel having a hyper-eutectoid composition where C content exceeds 0.8%. Moreover, since the addition of Si increases the eutectoid temperature of pearlite, a supercooling structure such as degenerate-pearlite or bainite tends to be generated in the temperature range of 480 to 650° C., which is a temperature range commonly used for a patenting treatment. As a result, after the patenting treatment, a reduction of area after breaking of a wire rod is lowered and the ductility thereof is deteriorated. In addition, the frequency of breakage increases during a drawing process, thereby deteriorating the productivity or yield.

The invention has been made in view of the above-described circumstances, and an object of the present invention is to provide a high strength wire rod and a method of producing the same, which has excellent drawability and high reduction of area, and can be produced with an inexpensive composition and with a high yield. Another object of the present invention is to provide a high strength steel wire excellent in drawability.

Expedients for Solving the Problems

As a result of thorough investigation, the present inventors have found that by including solid-solubilized B (B in a solid solution state) in an amount corresponding to the content of C and Si in austenite before subjecting the austenite to a patenting treatment, it is possible to provide a balanced driving force to the cementite precipitation and the ferrite precipitation and to thus obtain a high carbon pearlite wire rod having little amount of non-pearlite structure and high reduction of area, thereby providing excellent workability based on excellent drawability as well as a high strength. The invention has been accomplished based on these findings.

The gist of the present invention is as follows:

A first aspect of the present invention is a high strength wire rod having a high reduction of area, containing, in mass %, C: 0.7 to 1.2%, Si: 0.35 to 1.5%, Mn: 0.1 to 110%, N: 0.001 to 0.006%, Al: 0.005 to 0.1%, further containing B in an amount of 0.0004 to 0.0060% where an amount of solid-solubilized B is 0.0002% or more, and the balance consisting of Fe and unavoidable impurities, wherein a tensile strength TS (MPa) of the wire rod is specified by the following formula (1), $$TS \geqq [1000 \times C\ content\ (\%) - 10 \times wire\text{-}diameter\ (mm) + 450] \quad (1);\ and$$

in a portion from the surface to a depth of 100 μm, an area fraction of a non-pearlite structure is 10% or less, and the balance is composed of a pearlite structure, where the non-pearlite structure is composed of pro-eutectoid ferrite, degenerate-pearlite, or bainite generating along the grain boundaries of prior austenite.

A second aspect of the present invention is a high strength wire rod having a high reduction of area, containing, in mass %, C: 0.7 to 1.2%, Si: 0.35 to 1.5%, Mn: 0.1 to 1.0%, N: 0.001 to 0.006%, Al: 0.005 to 0.1%, further containing B in an amount of 0.0004 to 0.0060% where an amount of solid-solubilized B is 0.0002% or more, and the balance consisting of Fe and unavoidable impurities, wherein a tensile strength TS (MPa) of the wire rod is specified by the following formula (1), $$TS \geqq [1000 \times C\ content\ (\%) - 10 \times wire\text{-}diameter\ (mm) + 450] \quad (1);\ and$$

in a section from the surface to a central portion of the steel, an area fraction of a non-pearlite structure is 5% or less, and the balance is composed of a pearlite structure, where the non-pearlite structure is composed of pro-eutectoid ferrite, degenerate-pearlite, or bainite generating along the grain boundaries of prior austenite.

A third aspect of the present invention is a high strength wire rod having a high reduction of area, containing, in mass %, C: 0.7 to 1.2%, Si: 0.35 to 1.5%, Mn: 0.1 to 1.0%, N: 0.001 to 0.006%, Ti: 0.005 to 0.1%, further containing B in an amount of 0.0004 to 0.0060% where an amount of solid-solubilized B is 0.0002% or more, and the balance consisting of Fe and unavoidable impurities, wherein a tensile strength TS (MPa) of the wire rod is specified by the following formula (1), $$TS \geqq [1000 \times C\ content\ (\%) - 10 \times wire\text{-}diameter\ (mm) + 450] \quad (1);\ and$$

in a portion from the surface to a depth of 100 μm, an area fraction of a non-pearlite structure is 10% or less, and the balance is composed of a pearlite structure, where the non-pearlite structure is composed of pro-eutectoid ferrite, degenerate-pearlite, or bainite generating along the grain boundaries of prior austenite.

A fourth aspect of the present invention is a high strength wire rod having a high reduction of area, containing, in mass %, C: 0.7 to 1.2%, Si: 0.35 to 1.5%, Mn: 0.1 to 1.0%, N: 0.001 to 0.006%, Ti: 0.005 to 0.1%, further containing B in an amount of 0.0004 to 0.0060% where an amount of solid-solubilized B is 0.0002% or more, and the balance consisting of Fe and unavoidable impurities, wherein a tensile strength TS (MPa) of the wire rod is specified by the following formula (1), $$TS \geqq [1000 \times C\ content\ (\%) - 10 \times wire\text{-}diameter\ (mm) + 450] \quad (1);\ and$$

in a section from the surface to a central portion of the steel, an area fraction of a non-pearlite structure is 5% or less, and the balance is composed of a pearlite structure, where the non-pearlite structure is composed of pro-eutectoid ferrite, degenerate-pearlite, or bainite generating along the grain boundaries of prior austenite.

As a fifth aspect of the present invention, the high strength wire rod according to the above-described fourth aspect or the fifth aspect may further contain Al: 0.1% or less in mass %. The high strength wire rod of such a configuration is a high strength wire rod having excellent drawability.

As a sixth aspect of the present invention, a high strength wire rod according to a first to fifth aspect of the present invention may further contain one or more elements selected from the group consisting of, in mass %, Cr: 0.5% or less (not including 0%), Ni: 0.5% or less (not including 0%), Co: 0.5% or less (not including 0%), V: 0.5% or less (not including 0%), Cu: 0.2% or less (not including 0%), Mo: 0.2% or less (not including 0%), W: 0.2% or less (not including 0%), and Nb: 0.10% or less (not including 0%).

A seventh aspect of the present invention is a method of producing a wire rod, the method including: hot-rolling a steel in a form of a billet having the chemical composition as defined in any one of the above-described first to sixth aspects, coiling the rolled rod steel at a temperature of Tr=800 to 950° C.; and performing patenting treatment of the steel, wherein the patenting treatment is performed by directly dipping the steel in a molten salt of 480 to 650° C. within a period t1 (sec) after the cooling-coiling step subsequent to the hot-rolling, or by cooling the steel to a temperature of 200° C. or less by a process such as molten-salt cooling, Stelmore cooling, or natural air cooling, re-austenitizing the steel at a temperature of 950° C. or more, and dipping the steel in a molten lead of 480 to 650° C., where the t1 is defined by the following formula (2):

$$t1 = 0.0013 \times (Tr - 815)^2 + 7 \times (B\ content - 0.0003)/((N\ content - Ti\ content/3.41) \times 0.71 - B\ content + 0.0003) \quad (2),$$

wherein t1=40 seconds is selected as the period t1 to be used in the method if a value of (N content−Ti content/3.41−B content+0.0003) is zero or smaller, or if a value of t1 as calculated by the formula (2) is greater than 40 seconds.

An eighth aspect of the present invention is a method of producing a wire rod, the method including: hot-rolling steel in a from of a billet having die chemical composition as described in the above-described first to sixth aspects, cooling the steel directly after the hot-rolling, coiling the rolled steel at a temperature of Tr=800 to 950° C.; cooling the steel with a cooling rate within a range of 15 to 150° C./sec to a temperature range 480 to 650° C. within a period defined by the above-described formula (2) after the cooling-coiling step subsequent to the hot-rolling, and performing patenting treatment of the steel at the temperature range.

A ninth aspect of the present invention is a high strength steel wire produced by cold-drawing a wire rod which has been produced by a production method as described in the above-described seventh or eighth aspect using steel as described in any of the above-described first to sixth aspects, wherein a tensile strength of the steel is 1600 MPa or more, in a portion from the surface to a depth of 50 μm, an area fraction of a non-pearlite structure is 10% or less, and the balance is composed of a pearlite structure.

A tenth aspect of the present invention is a high strength steel wire produced bed cold-drawing a wire rod which has been produced by a production method as described in the above-described seventh or eighth aspect using steel as described in any of the above-described first to sixth aspects, wherein a tensile strength of the steel is 1600 MPa or more, in a section from the surface to a central portion of the steel wire, an area fraction of a non-pearlite structure is 5% or less, and the balance is composed of a pearlite structure.

Effect of the Invention

A high strength wire rod excellent in drawability according to the present invention has a composition containing, in mass %, C; 0.7 to 1.2%, Si: 0.35 to 1.5%, Mn: 0.1 to 1.0%, N: 0.001 to 0.006%, Al: 0.005 to 0.1%, further containing B in an amount of 0.0004 to 0.0060% where an amount of solid-solubilized B is 0.0002% or more, and the balance consisting of Fe and unavoidable impurities, wherein, a tensile strength TS (MPa) of the wire rod is specified by the formula: TS≧[1000×C content (%)−10×wire-diameter (mm)+450], in a portion from the surface to a depth of 100 μm, all area fraction of non-pearlite structure is 10% or less, and the balance is composed of a pearlite structure, or in a section from the surface to a central portion of the steel wire, an area fraction of a non-pearlite structure is 5% or less, and the balance is composed of a pearlite structure.

By controlling the amount of each component to satisfy the above-described relation and including solid-solubilized B in al amount corresponding to the content of C and Si in an austenite before subjecting the steel to a patenting treatment, it is possible to provide a balanced driving force to the cementite precipitation and the ferrite generation and thus to suppress formation of a non-pearlite structure, thereby improving ductility. In addition, it is possible to improve the productivity or yield of the wire rod.

In addition, it is possible to obtain a steel wire having a structure mainly composed of pearlite and showing a reduced area fraction of a non-pearlite structure. Therefore, it is possible to improve performance when used for PC steel wires, galvanized steel wires, spring steel wires, suspension bridge cables.

BEST MODE FOR CARRYING OUT THE INVENTION

Figure 1:
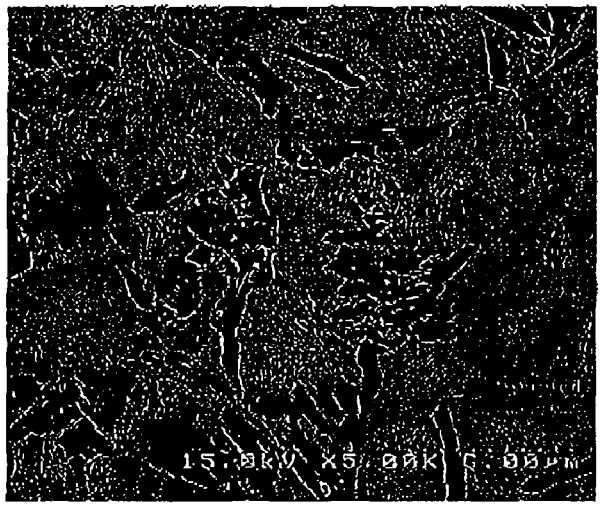
FIG. 1 is an example of a SEM (Scanning Electron Microscope) photograph. In the photograph, dark region is a non-pearlite structure composed of bainite, ferrite or the like, and the bright region is a pearlite structure.

Hereinafter, embodiments of a high strength wire rod excellent in drawability according to the present invention will be described with respect to the accompanying drawings.

The embodiments will be described in detail for better understanding of the concept of the present invention and, unless explicitly stated otherwise, are not intended to limit the present invention.

A high strength wire rod excellent in drawability according to the present invention has a configuration containing, in mass %, C: 0.7 to 1.2%, Si: 0.35 to 1.5%, Mn: 0.1 to 1.0%, N: 0.001 to 0.006%, Al: 0.005 to 0.1%, further containing B in an amount of 0.0004 to 0.0060% where an amount of solid-solubilized B is 0.0002% or more, and the balance consisting of Fe and unavoidable impurities, wherein a tensile strength TS (MPa) of the wire rod is specified by the following formula (1), $$TS \geqq [1000 \times C\ content\ (\%) - 10 \times wire\text{-}diameter\ (mm) + 450] \quad (1);\ and$$

in a portion from the surface to a depth of 100 μm, an area fraction of a non-pearlite structure composed of pro-eutectoid ferrite, degenerate-pearlite, or bainite generating along the grain boundaries of prior austenite is 10% or less, and the balance is composed of a pearlite structure, or in a section from the surface to a central portion of the steel wire, an area fraction of a non-pearlite structure is 5% or less, and the balance is composed of a pearlite structure.

Where the wire rod of the present embodiment contains, in mass %, Ti in a range of 0.005 to 0.1% as an alternative to Al in the above-described composition, the wire rod may have a composition containing B in an amount of 0.0004 to 0.0060% where an amount of solid-solubilized B is 0.0002% or more, and a composition further containing Al in an amount of 0.1% or less.

The wire rod excellent in drawability according to the present embodiment may have a composition, in addition to the above-described composition, further containing one or more elements selected from the group consisting of, in mass % Cr: 0.5% or less (not including 0%), Ni: 0.5% or less (not including 0%), Co: 0.5% or less (not including 0%), V: 0.5% or less (not including 0%), Cu: 0.2% or less (not including 0%), Mo: 0.2% or less (not including 0%), W: 0.2% or less (not including 0%), and Nb: 0.1% or less (not including 0%).

In the present embodiment, while limiting the component composition of a wire rod based on the below-described reasons, the coiling temperature during a coiling process, a period from the end of coiling to the start of patenting, and the cooling rate during the patenting treatment are limited, thereby suppressing the generation of a non-pearlite structure during pearlite transformation, and providing the wire rod with excellent strength properties and drawing workability.

Component Composition:

Hereinafter, the reasons for limiting the component composition of the high strength wire rod excellent in drawability according to the present embodiment will be explained.

C: 0.7 to 1.2%

C (Carbon) is an element effective for increasing the strength of a wire rod. If the content of C in the wire rod is less than 0.7%, it is difficult to stably provide the high strength as defined by the formula (1) to a final product. Also, the pro-eutectoid ferrite generation is accelerated at the austenite grain boundaries, and it is this difficult to obtain a uniform pearlite structure. On the other hand, if the C content in the wire rod is too high, a pro-eutectoid cementite network is formed at the austenite grain boundaries. Thus, breakage may easily occur during the drawing process and toughness and ductility of the ultra-fine wire rod obtained after a final drawing step is greatly deteriorated. For these reasons, the content of C in the wire rod is specified to be in the range from 0.7 to 1.2%, in mass Si: 0.35 to 1.5%

Si (Silicon) is an element effective for increasing the strength of a wire rod. Also, Si is a useful element as a deoxidizing agent and is a necessary element even in a production of a steel wire rod that does not contain Al. On the other hand, if the content of Si in the wire rod is too high, generation of pro-eutectoid ferrite is accelerated even in a hyper-eutectoid steel and the limit workability in the drawing process is degraded. In addition, mechanical de-scaling (hereinafter referred to as MD) becomes difficult. For these reasons, the content of Si in the wire rod is specified to be in the range from 0.35 to 1.5%, in mass %.

Mn: 0.1 to 1.0%

Mn (Manganese), like Si, is a useful element as a deoxidizing agent. Mn is effective for improving hardenability and increasing the strength of a wire rod. Further, Mn has a function of fixing S in the steel as MnS and preventing hot brittleness. If the Mn content is less than 0.1 mass %, it is difficult to obtain the above effects. On the other hand, since Mn is an element easy to segregate, if the Mn content is greater than 1.0 mass %, Mn segregates particularly in the central portion of the wire rod. In the segregated portion, martensites or bainites are generated and drawing workability is degraded. For these reasons, the content of Mn in the wire rod is specified to 0.1 to 1.0%, in mass %.

Al: 0.005 to 0.1%

Al (Aluminum) is effective as a deoxidizing agent. Further, Al has an effect of fixing N to inhibit aging and increase the content of solid-solubilized B. The Al content is preferably in the range of 0.005 to 0.1%, in mass %. If the content of Al in the wire rod is less than 0.005%, it is difficult to obtain the effect of fixing N. If the Al content is greater than 0.1%, a large amount of hard non-deformable alumina-based nonmetallic inclusions are generated and lower the ductility and drawability of the steel wire. In the case where the below-described Ti is added, by fixing of N by the Ti, it is possible to obtain the above-described effect without adding Al. Thus, it is not necessary to specify the lower limit of the Al content and the Al content may be 0%.

Ti: 0.005 to 0.1%

Ti (Titanium) is also effective as a deoxidizing agent. Since Ti is precipitated as TiN, Ti contributes to preventing coarsening of a grain size of austenite, and Ti is also effective for ensuring the amount of solid-solubilized B in austenite by fixing N. If the Ti content in the wire rod is less than 0.005%, it is difficult to obtain the above effect. On the other hand, if the Ti content is greater than 0.1%, there is a possibility that coarse carbides may be generated in the austenite and degrade the drawability. For these reasons, the content of Ti in the wire rod is specified to 0.005 to 0.1%, in mass %.

N: 0.001 to 0.006%

N (Nitrogen) generates nitrides of Al, B or Ti in the steel and has a function of preventing coarsening of the grain size of austenite at the time of heating. Such an effect can be effectively obtained by adding 0.001% or more of N. However, if the N content is too high, too much nitride is generated aid the amount of solid-solubilized B in the austenite is lowered. In addition, there is a possibility that solid-solubilized N accelerates the aging during the drawing process. For these reasons, the content of N in the wire rod is specified to 0.001 to 0.006%, in mass %.

B: 0.0004 to 0.0060%

Where B (Boron) is included in austenite in a solid solution state, B has an effect of suppressing generation of pro-eutectoid ferrite and accelerating precipitation of pro-eutectoid cementite by being concentrated in grain boundaries. Therefore, by adding B to the afire rod in all amount determined in consideration of its balance with the C and Si contents, it is possible to suppress the generation of pro-eutectoid ferrites. Since B forms nitrides, the B content should be determined in consideration of its balance with the N content in addition to the C and Si contents in order to ensure the amount of B in the solid solution state. If the B content is too high, there is a possibility that precipitation of pro-eutectoid cementite is accelerated and coarse $Fe_3(CB)_6$ carbides are generated in the austenite, thereby degrading the drawability. Though numerous experiments regarding their content relation, the present inventors have found that an optimum range of B content in the wire rod be specified to 0.0004 to 0.0060%, in mass %. Since B needs to be present in the solid solution state before the patenting treatment, it is necessary to control the amount of solid-solubilized B in the wire rod after the rolling to be 0.0002% or more.

Although the contents of impurities P and S are not particularly specified, the content of each of P and S is preferably specified to 0.02% or less, in mass % from the viewpoint of securing the ductility similar to the case of the conventional ultra-fine steel wire.

The high strength steel wire rod described in the present embodiment has the above-described components as a fundamental composition. However, one or more of the following selectively allowable additive elements may be positively included in the wire rod for the purpose of improving mechanical properties such as strength, toughness and ductility.

Cr: 0.5% or Less

Cr (Chromium) is an effective element for refining a spacing of pearlite lamella and improving the strength or drawing workability of a wire rod. In order to attain such an effect, Cr is preferably added in an amount of 0.1% or more. If the Cr content is too high, it may extend a transformation end time and excessively cooled structures such as martensites or bainites may be generated in the hot-rolled wire rod. Further, mechanical de-scalability is degraded. For these reasons, the upper limit of the Cr content is specified to 0.5%, in mass %.

Ni: 0.5% or Less

Ni (Nickel) is all element that does not contribute much to increasing the strength of the wire rod but is effective for increasing toughness of the drawn wire rod. In order to attain such an effect, Ni is preferably added in an amount of 0.1% or more. On the other hand, if the Ni content is too high, the transformation end time is extended. For this reason, the upper limit of the Ni content is specified to 0.5%, in mass %.

Co: 0.5% or Less

Co (Cobalt) is an effective element for suppressing the pro-eutectoid precipitation in the rolled materials. In order to attain such an effect, Co is preferably added in an amount of 0.1% or more. On the other hand, even if too much Co is added, the effect is saturated. Therefore, an excessive amount provides no advantages and there is a possibility of increasing the production cost. For these reasons, the upper limit of the Co content is specified to 0.5%, in mass V: 0.5% or Less By forming fine carbonitrides in ferrites, V (Vanadium) prevents coarsening of the grain size of austenite at the time of heating, and contributes to increasing the strength of the rolled materials. In order to attain such effects, V is preferably added in an amount of 0.05% or more. On the other hand, if too much V is added, an excessively large amount of carbonitrides are formed and the particle size of the carbonitrides also increases. For these reasons, the upper limit of the V content is specified to 0.5%, in mass %.

Cu: 0.2% or Less

Cu (Copper) has an effect of increasing the corrosion resistance of ultra-fine steel wire. In order to attain such an effect, Cu is preferably added in an amount of 0.1% or more. On the other hand) if too much Cu is added, Cu reacts with S to be segregated as CuS at the grain boundaries, thereby causing defects in the steel ingot or wire rod in the course of the wire rod production process. To prevent such an adverse effect, the upper limit of the Cu content is specified to 0.2%, in mass %.

Mo: 0.2% or Less

Mo (Molybdenum) has an effect of increasing the corrosion resistance of ultra-fine steel wire. In order to attain such an effect, Mo is preferably added in all amount of 0.1% or more. On the other hand, if too much Mo is added, the transformation end time is extended. For this reason, lie upper limit of the Mo content is specified to 0.2%, in mass %.

W: 0.2% or Less

W (Tungsten) has an effect of increasing the corrosion resistance of ultra-fine steel wire. In order to attain such an effect, W is preferably added in an amount of 0.1% or more. On the other hand, if too much W is added, die transformation end time is extended. For these reasons, the upper limit of the W content is specified to 0.2%, in mass %.

Nb: 0.1% or Less

Nb (Niobium) has an effect of increasing the corrosion resistance of ultra-fine steel wire. In order to attain such an effect, Nb is preferably added in an amount of 0.05% or more. On the other hand, if too much Nb is added, the transformation end time is extended. For these reasons, the upper limit of the Nb content is specified to 0.1%, in mass %.

Structure of Wire Rod

According to various studies of the present inventors, it has become obvious that non-pearlite has a particular influence on the drawing workability of a wire rod, where the non-pearlite is mainly composed of bainite that is generated at the grain boundaries of prior austenite of the wire rod, and includes additional pro-eutectoid ferrite and degenerate-pearlite. In the present embodiment, by controlling the area fraction of a non-pearlite structure to be 10% or less in a portion from the surface to a depth of 100 μm, it was confirmed that drawing workability was improved and the occurrence of delamination can be suppressed.

In the present embodiment, a steel satisfying the above-described requirements for the component composition is used as a wire rod material. After hot-rolling the steel, the steel is directly subjected to a patenting treatment. Alternatively, the steel may be subjected to a patenting treatment after reaustenitization of the steel subsequent to rolling and cooling the steel. As a result, it is possible to obtain a wire rod, wherein pearlite constitutes a main structure and an area fraction of a non-pearlite structure is 10% or less in a portion from the surface to a depth of 100 μm.

Since breakage during the drawing of a wire rod frequently occurs as cuppy breakage caused by structural failure in the central portion of the wire rod, it is effective for reducing a breakage frequency of the wire rod to improve a reduction of area after the patenting. In the present embodiment, by controlling the area fraction of a non-pearlite structure to be 5% or less in a section of the wire rod from the surface to a central portion of the wire rod, it was confirmed that reduction of area can be improved.

FIG. 1 is a SEM (Scanning Electron Microscope) photograph showing an example of a structure of a patented wire rod of the present embodiment. It can be observed that a pearlite structure (bright region) constitutes a predominant area compared to the non-pearlite structure (dark region) composed of bainitem ferrite or the like.

Production Method

Figure 2:
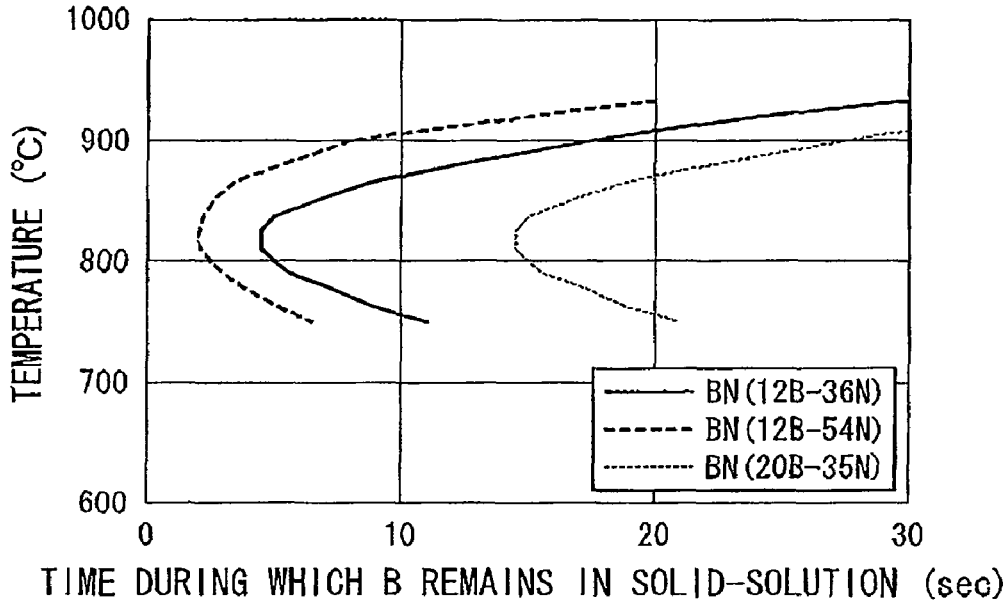
FIG. 2 is a graph showing a precipitation curve of BN for cases of different amounts of B and N.

To obtain the wire rod having the structure and tensile strength as defined in the present embodiments using the steel having the component composition as defined in the present embodiment, it is necessary that B does not form carbides or nitrides during conveying the coiled steel for subjecting the steel to patenting treatment after rolling and coiling the steel and that the steel is cooled during the patenting treatment with a cooling rate not slower than a predetermined value. According to investigation of the present inventors, when a wire rod was heated at a temperature of 1050° C., rapidly cooled at a temperature of 750 to 950° C. within 1 second, held at that temperature for a predetermined period, and subjected to lead patenting, as a result of examination of the structure and the amount of solid-solubilized B of the thus obtained wire rod, it has been found that a limit holding time for the wire rod to include 0.0002% or more of solid-solubilized B can be plotted by the C-shaped curve which is determined by the combination of the B and N contents as shown in FIG. 2, and that the time t1 can be specified by the following formula (2).

$$t1=0.0013\times(Tr-815)^2+7\times(\text{B content}-0.0003)/((\text{N content}-\text{Ti content}/3.41)\times0.71-\text{B content}+0.0003) \quad (2)$$

In the formula (2), Tr is the coiling temperature. The formula (2) is valid in a range of composition where the term, ((N content−Ti content/3.41)×0.71−B content+0.0003) has a value greater than zero. If the term has a value equal to or smaller than zero, the holding time is not particularly limited. In the practical rolling process, it does not take longer than 40 seconds when measured from the end of coiling to the start of a patenting treatment. Therefore, the upper limit of the holding time is specified to 40 seconds. On the basis of the foregoing, it is necessary to water-cool the wire rod rolled at a temperature of 1050° C. or more, to coil the cooled wire rod at a temperature of 800° C. or more, preferably 850° C. or more and 950° C. or less, and to control the process time taken from the end of coiling to the start of the patenting treatment to be within the time as specified by the formula (2). If the temperature at the time of coiling is lower than 800° C., B is precipitated as carbides in the wire rod and thus B has an insufficient effect as solid-solubilized B for suppressing the formation of non-pearlite structures. If the temperature at the time of coiling is higher than 950° C., the y grain size becomes coarse and thus the reduction of area of the wire rod is degraded.

After the wire rod is coiled, the patenting treatment is performed. Patenting treatment of the wire rod may be performed by a method of patenting by directly dipping in a molten-salt or a molten lead at a temperature of 480 to 650° C., by a method of patenting by cooling the wire rod, and reaustenizing the wire rod by heating at a temperature of 950° C. or more, and dipping the wire rod in a molten lead at a temperature of 480 to 650° C., or by a method of patenting by cooling the wire rod to a temperature in a range of 480 to 650° C. with a cooling rate of 15 to 150° C./sec (here, the cooling rate denotes a rate of cooling from the starting temperature of the cooling to a starting temperature (at about 700° C.) of recalascence caused by transformation), and performing patenting of the wire rod at that temperature range. The patenting treatment of the wire rod may be performed by any of the above-described methods. By this patenting treatment, it is possible to control the non-pearlite structure in a section of the wire rod to be 5% or less, and to ensure a tensile strength not lower than a value which is specified by the following formula (1):

$$[1000\times\text{C content }(\%)-10\times\text{wire-diameter (mm)}+450]\ \text{MPa} \quad (1).$$

In addition, in order to suppress the supercooling and control the area fraction of the non-pearlite structure to be 10% or less in a portion from the surface to a depth of 100 μm, it is preferable to control the temperature of the molten salt or the molten lead to be not lower than 520° C.

In the present embodiment, by controlling the diameter of the wire rod to be in a range of 5.5 to 18 mm, it is possible to obtain stably an excellent drawability and high strength.

EXAMPLES

Next, the present invention is explained specifically with reference to the examples. While it should be noted that the present invention is not limited to the below-described examples, and can be performed by changing in conformity with the above- and below-described scope of the invention. All of these alternative embodiments are included in the technical range of the present invention.

Method of Producing Sample Steel

Using a continuous casting plant, sample steels having the component compositions, in mass % of each element, as specified in Tables 1 and 3 were continuously cast into cast slabs having a sectional size of 300×500 mm. The cast slabs were bloomed into billets having a diagonal length of 122 mm in angular cross section. Thereafter, each of the billets was rolled into a wire rod having a diameter as specified in Tables 2 and 4, coiled at a predetermined temperature, and subjected to a direct molten-salt patenting (DLP) treatment or to a reheating and molten-lead patenting (LP) cooling within a predetermined time after finishing the coiling. Thus, the high strength wire rods excellent in drawability (Inventive Steels) 1 to 30 according to the present invention and the convention wire rods (Comparative Steels) 31 to 55 were produced. Production conditions for each wire rod are shown in Tables 2 and 4.

Evaluation Test Method

Solid-Solubilized B

The amount of B present as a chemical compound in electrolytically extracted residues of the patented wire rod was measured using curcumin-based absorption spectroscopy, and the amount of B in the solid solution state was calculated by subtracting the measured B amount from a total amount of B.

Area Fraction of Non-Pearlite Structure

The patented wire rod and the drawn wire rod were embedded and ground and thereafter subjected to chemical erosion using picric acid, and the fraction of a non-pearlite structure in a section (L section) parallel to the longitudinal direction of the wire rod was determined based on SEM observation. The fraction of the non-pearlite structure of the rolled wire rod was measured as follows, Bay incising and grinding the wire rod, the L section was exposed in a position corresponding to ±5% of the radius from the center of the wire rod. In SEM observation, structure photographs with a magnification of 2000 were taken from each of 5 views of 100 μM in depth× 100 μm in width on the surface layer of the L section of the wire rod, and the area fraction of non-pearlite was determined as an average area fraction measured by the image analysis. On the other hand, the fraction of the non-pearlite structure in the drawn wire rod was measured as follows. By incising and grinding the wire rod, the L section was exposed in a position corresponding to ±5% of the radius from the center of the wire rod. By SEM observation, photographs with a magnification of 2000 were taken from each of 5 views of 50 μm in depth× 100 μm in width on the surface layer of the L section of the wire rod, and the area fraction of non-pearlite was determined as an average area fraction measured by the image analysis. When a decarburized layer was present on the surface layer, the totally decarburized portion as specified as 4 in JIS G 0558 was excluded from the measurement. The measurement results showed that the area fraction of the non-pearlite structure before the drawing process was substantially the same as the area fraction of the non-pearlite structure after the drawing process.

Tensile Strength

The tensile strength was measured three times and an average was calculated under conditions that a gauge length of 200 mm and a cross head speed of 10 mm/min were used.

Tables 2 and 4 show the evaluation results of the strength of the patented wire rod, the area fraction of the non-pearlite structure, and the amount of the solid-solubilized B (in mass %).

TABLE 1

| | | Element | | | | | | | | | | | | | | | | |
|---|---|---|---|---|---|---|---|---|---|---|---|---|---|---|---|---|---|---|
| No. | | C | Si | Mn | P | S | B | Al | Ti | N | Cr | Mo | Ni | Cu | V | Co | W | Nb |
| 1 | Inv. Steel | 0.70 | 0.40 | 0.45 | 0.019 | 0.025 | 0.0034 | 0.029 | 0.000 | 0.0025 | — | — | — | — | — | — | — | — |
| 2 | Inv. Steel | 0.80 | 0.42 | 0.7 | 0.015 | 0.013 | 0.0027 | 0.031 | 0.000 | 0.0024 | — | — | — | — | — | — | — | — |
| 3 | Inv. Steel | 0.92 | 0.40 | 0.7 | 0.019 | 0.025 | 0.0031 | 0.032 | 0.000 | 0.0034 | — | — | 0.10 | — | — | — | — | — |
| 4 | Inv. Steel | 0.92 | 0.80 | 0.5 | 0.025 | 0.020 | 0.0042 | 0.030 | 0.000 | 0.0040 | — | — | — | — | — | — | 0.10 | 0.10 |
| 5 | Inv. Steel | 0.82 | 0.90 | 0.7 | 0.025 | 0.020 | 0.0036 | 0.030 | 0.000 | 0.0025 | — | — | — | — | 0.20 | — | — | — |
| 6 | Inv. Steel | 0.87 | 1.00 | 0.5 | 0.008 | 0.007 | 0.0052 | 0.030 | 0.000 | 0.0050 | 0.20 | — | — | — | — | — | — | — |
| 7 | Inv. Steel | 0.97 | 0.95 | 0.6 | 0.008 | 0.007 | 0.0026 | 0.031 | 0.000 | 0.0020 | 0.20 | 0.20 | — | — | — | — | — | — |
| 8 | Inv. Steel | 1.10 | 1.20 | 0.5 | 0.010 | 0.009 | 0.0021 | 0.000 | 0.010 | 0.0050 | 0.20 | — | — | 0.10 | — | — | — | — |
| 9 | Inv. Steel | 0.90 | 0.90 | 0.8 | 0.010 | 0.009 | 0.0021 | 0.000 | 0.005 | 0.0030 | — | — | 0.10 | — | — | — | — | — |
| 10 | Inv. Steel | 0.84 | 1.00 | 0.4 | 0.015 | 0.013 | 0.0030 | 0.000 | 0.010 | 0.0025 | 0.20 | — | — | — | — | 0.30 | — | — |
| 11 | Inv. Steel | 1.12 | 1.00 | 0.3 | 0.015 | 0.013 | 0.0029 | 0.030 | 0.000 | 0.0025 | — | — | — | — | — | 0.30 | — | — |
| 12 | Inv. Steel | 0.72 | 1.50 | 0.5 | 0.015 | 0.013 | 0.0048 | 0.028 | 0.000 | 0.0025 | — | — | — | — | 0.20 | — | — | — |
| 13 | Inv. Steel | 0.92 | 0.60 | 0.5 | 0.025 | 0.020 | 0.0040 | 0.080 | 0.000 | 0.0040 | — | — | — | — | — | — | 0.10 | 0.10 |
| 14 | Inv. Steel | 0.82 | 0.80 | 0.5 | 0.025 | 0.020 | 0.0042 | 0.030 | 0.000 | 0.0035 | — | — | — | — | 0.20 | — | — | — |
| 15 | Inv. Steel | 0.87 | 1.20 | 0.5 | 0.008 | 0.007 | 0.0050 | 0.030 | 0.000 | 0.0045 | 0.20 | — | — | — | — | — | — | — |
| 31 | Comp. Steel | 0.70 | 0.35 | 0.6 | 0.008 | 0.007 | 0.0032 | 0.030 | 0.000 | 0.0020 | — | 0.20 | — | — | — | — | — | — |
| 32 | Comp. Steel | 1.20 | 1.20 | 0.5 | 0.010 | 0.009 | 0.0007 | 0.000 | 0.010 | 0.0050 | 0.20 | — | — | 0.10 | — | — | — | — |
| 33 | Comp. Steel | 0.90 | 0.90 | 0.8 | 0.010 | 0.009 | 0.0065 | 0.000 | 0.005 | 0.0060 | — | — | 0.10 | — | — | — | — | — |
| 34 | Comp. Steel | 0.87 | 1.60 | 0.4 | 0.015 | 0.013 | 0.0042 | 0.000 | 0.010 | 0.0025 | 0.20 | — | — | — | — | — | — | — |
| 35 | Comp. Steel | 1.30 | 1.00 | 0.3 | 0.015 | 0.013 | 0.0022 | 0.030 | 0.000 | 0.0025 | — | — | — | — | — | 0.30 | — | — |
| 36 | Comp. Steel | 0.92 | 0.42 | 1.5 | 0.015 | 0.013 | 0.0025 | 0.025 | 0.000 | 0.0025 | — | — | — | — | 0.20 | — | — | — |
| 37 | Comp. Steel | 0.92 | 0.80 | 0.5 | 0.025 | 0.020 | 0.0011 | 0.035 | 0.000 | 0.0040 | — | — | — | — | — | — | 0.10 | 0.10 |
| 38 | Comp. Steel | 0.82 | 0.80 | 0.5 | 0.025 | 0.020 | 0.0040 | 0.030 | 0.000 | 0.0035 | — | — | — | — | 0.20 | — | — | — |
| 39 | Comp. Steel | 0.80 | 0.40 | 0.45 | 0.019 | 0.025 | 0.0034 | 0.036 | 0.000 | 0.0025 | — | — | — | — | — | — | — | — |
| 40 | Comp. Steel | 0.80 | 0.35 | 0.45 | 0.019 | 0.025 | 0.0034 | 0.036 | 0.000 | 0.0025 | — | — | — | — | — | — | — | — |
| 41 | Comp. Steel | 0.70 | 1.50 | 0.5 | 0.008 | 0.007 | 0.0085 | 0.030 | 0.000 | 0.0060 | 0.20 | — | — | — | — | — | — | — |
| 42 | Comp. Steel | 1.20 | 0.40 | 0.5 | 0.008 | 0.007 | 0.0003 | 0.030 | 0.000 | 0.0010 | 0.20 | — | — | — | — | — | — | — |
| 43 | Comp. Steel | 1.20 | 0.40 | 0.5 | 0.008 | 0.007 | — | 0.001 | 0.010 | 0.0010 | 0.20 | — | — | — | — | — | — | — |

TABLE 2

| No | DIAMETER OF ROLLED WIRE (mm) | COILING TEMP. (° C.) | PERIOD OF COILING-PATENTING (sec) | UPPER LIMIT OF PERIOD | PATENTING METHOD | TEMP. OF SALT OR LEAD (° C.) | COOLING RATE (° C./sec) |
|---|---|---|---|---|---|---|---|
| 1 INVENTIVE | 5.5 | 900 | 15.0 | 40 | DLP | 550 | 85 |
| 2 STEEL | 18.0 | 900 | 26.7 | 40 | DLP | 520 | 25 |
| 3 | 5.5 | 910 | 15.0 | 40 | DLP | 550 | 85 |
| 4 | 8.0 | 880 | 17.1 | 40 | DLP | 575 | 56 |
| 5 | 12.5 | 950 | 20.0 | 40 | DLP | 600 | 24 |
| 6 | 13.5 | 910 | 21.8 | 40 | DLP | 550 | 30 |
| 7 | 9.0 | 890 | 17.1 | 40 | DLP | 550 | 48 |
| 8 | 10.0 | 860 | 18.5 | 40 | DLP | 550 | 43 |
| 9 | 5.5 | 900 | 15.0 | 40 | DLP | 550 | 59 |
| 10 | 12.5 | 910 | 20.0 | 40 | LP | 575 | 48 |
| 11 | 15.0 | 905 | 21.8 | 40 | DLP | 505 | 41 |
| 12 | 12.0 | 920 | 20.0 | 40 | DLP | 550 | 35 |
| 13 | 6.0 | 900 | 15.0 | 40 | DLP | 550 | 78 |
| 14 | 9.0 | 900 | 17.1 | 40 | DLP | 550 | 48 |
| 15 | 14.5 | 905 | 24.0 | 40 | DLP | 550 | 28 |
| 31 COMPARATIVE | 5.5 | 750 | 15.0 | 40 | DLP | 550 | 85 |
| 32 STEEL | 12.0 | 890 | 20.0 | 9.9 | DLP | 550 | 35 |
| 33 | 5.5 | 880 | 15.0 | 40 | DLP | 550 | 85 |
| 34 | 13.0 | 900 | 21.8 | 40 | DLP | 550 | 40 |
| 35 | 13.5 | 910 | 24.0 | 40 | DLP | 550 | 38 |
| 36 | 5.5 | 920 | 16.0 | 40 | DLP | 550 | 85 |
| 37 | 6.0 | 900 | 16.0 | 12.2 | DLP | 550 | 100 |
| 38 | 7.0 | 900 | 17.1 | 40 | LP | 450 | 92 |
| 39 | 10.0 | 900 | 20.0 | 40 | AP | — | 4 |
| 40 | 10.0 | 900 | 21.8 | 40 | AP | — | 11 |
| 41 | 12.0 | 900 | 21.8 | 40 | DLP | 550 | 35 |
| 42 | 12.0 | 900 | 24.0 | 9.4 | DLP | 550 | 35 |
| 43 | 12.0 | 900 | 26.5 | — | DLP | 550 | 35 |

| No | PATENTED WIRE STRENGTH (MPa) | TS THRESHOLD (MPa) | REDUCTION OF AREA PATENTED WIRE ROD (%) | AREA FRACTION OF NON-PEARLITE (%) | AREA FRACTION OF NON-PEARLITE IN SURFACE (%) | AMOUNT OF SOLID-SOLUTION B |
|---|---|---|---|---|---|---|
| 1 INVENTIVE | 1230 | 1095 | 52 | 3.3 | 8.2 | 0.0011 |
| 2 STEEL | 1190 | 1070 | 53 | 3.1 | 8.6 | 0.0004 |
| 3 | 1325 | 1315 | 47 | 2.5 | 7.9 | 0.0009 |
| 4 | 1426 | 1290 | 44 | 2.2 | 4.6 | 0.0008 |
| 5 | 1291 | 1145 | 51 | 4.6 | 5.2 | 0.0011 |
| 6 | 1446 | 1185 | 46 | 1.1 | 4.6 | 0.0005 |
| 7 | 1545 | 1330 | 41 | 0.9 | 6.8 | 0.0005 |
| 8 | 1590 | 1450 | 35 | 2.3 | 3.3 | 0.0015 |
| 9 | 1514 | 1295 | 44 | 1.8 | 3.7 | 0.0014 |
| 10 | 1441 | 1165 | 45 | 2.4 | 4.8 | 0.0026 |
| 11 | 1620 | 1420 | 36 | 2.8 | 11.8 | 0.0004 |
| 12 | 1375 | 1050 | 45 | 2.7 | 4.5 | 0.0023 |
| 13 | 1454 | 1310 | 46 | 2.1 | 8 | 0.0006 |
| 14 | 1365 | 1180 | 48 | 1.9 | 7.3 | 0.0012 |
| 15 | 1436 | 1175 | 45 | 1.6 | 7.5 | 0.0008 |
| 31 COMPARATIVE | 1145 | 1095 | 45 | 5.3 | 18.6 | 0.0006 |
| 32 STEEL | 1610 | 1530 | 26 | 6.3 | 13.9 | <0.0002 |
| 33 | 1465 | 1295 | 36 | 0.9 | 11.2 | 0.0036 |
| 34 | 1532 | 1190 | 26 | 10.2 | 58.9 | 0.0032 |
| 35 | 1653 | 1615 | 23 | 4.2 | 9.8 | 0.0007 |
| 36 | 1345 | 1315 | 39 | 3.2 | 5.6 | 0.0004 |
| 37 | 1475 | 1310 | 36 | 6.3 | 16.8 | <0.0002 |
| 38 | 1380 | 1200 | 39 | 5.5 | 62.1 | 0.0009 |
| 39 | 970 | 1150 | 47 | 1.2 | 6.8 | 0.0011 |
| 40 | 1040 | 1150 | 45 | 0.8 | 5.2 | 0.0012 |
| 41 | 1465 | 1030 | 36 | 4.1 | 6.2 | 0.0028 |
| 42 | 1598 | 1530 | 32 | 7.2 | 13.2 | <0.0002 |
| 43 | 1598 | 1530 | 32 | 6.7 | 14.5 | — |

TABLE 3

| No. | | Element | | | | | | | | | | | | | | | | |
|---|---|---|---|---|---|---|---|---|---|---|---|---|---|---|---|---|---|---|
| | | C | Si | Mn | P | S | B | Al | Ti | N | Cr | Mo | Ni | Cu | V | Co | W | Nb |
| 16 | Inv. Steel | 0.70 | 0.80 | 0.45 | 0.019 | 0.025 | 0.0025 | 0.029 | 0.000 | 0.0025 | — | — | — | — | — | — | — | — |
| 17 | Inv. Steel | 0.80 | 0.42 | 0.7 | 0.015 | 0.013 | 0.0022 | 0.031 | 0.000 | 0.0024 | — | — | — | — | — | — | — | — |
| 18 | Inv. Steel | 0.92 | 0.60 | 0.7 | 0.019 | 0.025 | 0.0031 | 0.032 | 0.000 | 0.0052 | — | — | 0.10 | — | — | — | — | — |
| 19 | Inv. Steel | 0.87 | 0.90 | 0.75 | 0.008 | 0.005 | 0.0018 | 0.045 | 0.010 | 0.0045 | 0.03 | — | 0.03 | 0.03 | — | — | — | — |
| 20 | Inv. Steel | 0.85 | 0.90 | 0.75 | 0.008 | 0.005 | 0.0018 | 0.045 | 0.005 | 0.0035 | 0.01 | — | — | — | — | — | — | — |
| 21 | Inv. Steel | 0.87 | 1.10 | 0.5 | 0.008 | 0.007 | 0.0021 | 0.030 | 0.000 | 0.0033 | 0.20 | — | — | — | — | — | — | — |
| 22 | Inv. Steel | 0.97 | 0.95 | 0.6 | 0.008 | 0.007 | 0.0026 | 0.042 | 0.000 | 0.0036 | 0.20 | 0.20 | — | — | — | — | — | — |
| 23 | Inv. Steel | 1.10 | 0.80 | 0.5 | 0.010 | 0.009 | 0.0012 | 0.000 | 0.010 | 0.0045 | 0.20 | — | — | 0.10 | — | — | — | — |
| 24 | Inv. Steel | 0.90 | 0.90 | 0.8 | 0.010 | 0.009 | 0.0012 | 0.000 | 0.000 | 0.0030 | — | — | 0.10 | — | — | — | — | — |
| 25 | Inv. Steel | 0.87 | 1.10 | 0.5 | 0.008 | 0.007 | 0.0019 | 0.030 | 0.000 | 0.0033 | 0.01 | — | — | — | — | — | — | — |
| 26 | Inv. Steel | 0.85 | 0.90 | 0.75 | 0.008 | 0.005 | 0.0020 | 0.045 | 0.000 | 0.0032 | 0.20 | — | — | — | — | 0.30 | — | — |
| 27 | Inv. Steel | 0.72 | 1.50 | 0.5 | 0.015 | 0.013 | 0.0048 | 0.028 | 0.000 | 0.0055 | — | — | — | — | 0.20 | — | — | — |
| 25 | Inv. Steel | 0.72 | 1.45 | 0.5 | 0.015 | 0.013 | 0.0029 | 0.028 | 0.000 | 0.0021 | — | — | — | — | — | — | 0.10 | 0.10 |
| 29 | Inv. Steel | 0.82 | 0.80 | 0.5 | 0.025 | 0.020 | 0.0012 | 0.030 | 0.040 | 0.0051 | — | — | — | — | 0.20 | — | — | — |
| 30 | Inv. Steel | 0.87 | 1.20 | 0.5 | 0.008 | 0.007 | 0.0025 | 0.030 | 0.000 | 0.0045 | 0.20 | — | — | — | — | — | — | — |
| 44 | Comp. Steel | 0.70 | 0.40 | 0.6 | 0.008 | 0.007 | 0.0016 | 0.030 | 0.000 | 0.0020 | — | 0.20 | — | — | — | — | — | — |
| 45 | Comp. Steel | 0.90 | 0.90 | 0.8 | 0.010 | 0.009 | 0.0062 | 0.000 | 0.005 | 0.0060 | — | — | 0.10 | — | — | — | — | — |
| 46 | Comp. Steel | 0.87 | 1.60 | 0.4 | 0.015 | 0.013 | 0.0021 | 0.000 | 0.000 | 0.0036 | 0.20 | — | — | — | — | — | — | — |
| 47 | Comp. Steel | 0.92 | 0.42 | 1.5 | 0.015 | 0.013 | 0.0018 | 0.025 | 0.000 | 0.0025 | — | — | — | — | 0.20 | — | — | — |
| 48 | Comp. Steel | 0.92 | 0.80 | 0.5 | 0.025 | 0.020 | 0.0003 | 0.035 | 0.000 | 0.0040 | — | — | — | — | — | — | 0.10 | 0.10 |
| 49 | Comp. Steel | 0.82 | 0.80 | 0.5 | 0.025 | 0.020 | 0.0031 | 0.030 | 0.000 | 0.0035 | — | — | — | — | — | — | — | — |
| 50 | Comp. Steel | 0.70 | 1.60 | 0.5 | 0.008 | 0.007 | 0.0011 | 0.030 | 0.000 | 0.0060 | 0.20 | — | — | — | — | — | — | — |
| 51 | Comp. Steel | 1.10 | 0.40 | 0.5 | 0.008 | 0.007 | 0.0003 | 0.030 | 0.000 | 0.0028 | 0.20 | — | — | — | — | — | — | — |
| 52 | Comp. Steel | 0.70 | 1.50 | 0.5 | 0.008 | 0.007 | 0.0009 | 0.030 | 0.000 | 0.0026 | 0.20 | — | — | — | — | — | — | — |
| 53 | Comp. Steel | 0.87 | 0.90 | 0.75 | 0.008 | 0.005 | 0.0018 | 0.045 | 0.000 | 0.0035 | 0.03 | — | 0.30 | 0.30 | — | — | — | — |
| 54 | Comp. Steel | 0.87 | 1.10 | 0.5 | 0.008 | 0.007 | 0.0013 | 0.030 | 0.000 | 0.0033 | 0.20 | — | — | — | — | — | — | — |
| 55 | Comp. Steel | 1.20 | 0.80 | 0.5 | 0.008 | 0.007 | — | 0.001 | 0.000 | 0.0036 | 0.20 | — | — | — | — | — | — | — |

TABLE 4

| No. | | DIAMETER OF ROLLED WIRE (mm) | COILING TEMP. (° C.) | PERIOD OF COILING-PATENTING (sec) | UPPER LIMIT OF PERIOD | PATENTING METHOD | TEMP. OF SALT OR LEAD (° C.) | COOLING RATE (° C./sec) |
|---|---|---|---|---|---|---|---|---|
| 16 | INVENTIVE | 5.0 | 850 | 11.2 | 40 | DLP | 550 | 85 |
| 17 | STEEL | 17.0 | 850 | 16.6 | 40 | DLP | 530 | 25 |
| 18 | | 6.0 | 855 | 11.3 | 24.1 | DLP | 550 | 85 |
| 19 | | 12.0 | 825 | 14.6 | 40 | DLP | 550 | 47 |
| 20 | | 12.5 | 875 | 16.2 | 40 | DLP | 600 | 24 |
| 21 | | 11.5 | 825 | 16.2 | 23.3 | DLP | 550 | 30 |
| 22 | | 10.0 | 890 | 12.6 | 40 | DLP | 550 | 48 |
| 23 | | 9.0 | 860 | 12.6 | 32.2 | DLP | 550 | 43 |
| 24 | | 5.0 | 900 | 11.2 | 14.5 | DLP | 560 | 59 |
| 25 | | 12.0 | 875 | 16.2 | 19.8 | LP | 570 | 48 |
| 26 | | 14.0 | 825 | 16.3 | 20.9 | DLP | 550 | 41 |
| 27 | | 13.0 | 920 | 16.7 | 40 | DLP | 490 | 35 |
| 28 | | 6.5 | 940 | 11 | 40 | DLP | 550 | 78 |
| 29 | | 8.0 | 810 | 12.7 | 40 | DLP | 550 | 48 |
| 30 | | 14.0 | 905 | 16.8 | 26 | DLP | 550 | 28 |
| 44 | COMPARATIVE | 8.3 | 750 | 13.3 | 40 | DLP | 550 | 85 |
| 45 | STEEL | 5.5 | 880 | 12.0 | 40 | DLP | 550 | 85 |
| 46 | | 13.0 | 900 | 16.9 | 26.1 | DLP | 500 | 40 |
| 47 | | 5.5 | 920 | 12.0 | 40 | DLP | 550 | 85 |
| 48 | | 6.0 | 850 | 12.0 | 1.59 | DLP | 550 | 100 |
| 49 | | 7.0 | 855 | 12.6 | 40 | LP | 450 | 92 |
| 50 | | 7.0 | 825 | 12.6 | 1.75 | DLP | 550 | 35 |
| 51 | | 10.0 | 900 | 15.0 | 9.4 | DLP | 550 | 39 |
| 52 | | 12.0 | 820 | 17.1 | 3.4 | DLP | 550 | 35 |
| 53 | | 12.0 | 825 | 17.1 | 10.8 | DLP | 550 | 47 |
| 54 | | 13.5 | 825 | 18.5 | 5.3 | DLP | 550 | 30 |
| 55 | | 12.5 | 900 | 17.1 | — | DLP | 550 | 35 |

TABLE 4-continued

| No. | | PATENTED WIRE STRENGTH (MPa) | TS THRESHOLD (MPa) | REDUCTION OF AREA PATENTED WIRE ROD (%) | AREA FRACTION OF NON-PEARLITE IN SURFACE (%) | AREA FRACTION OF NON-PEARLITE IN SECTION (%) | AMOUNT OF SOLID-SOLUTION B |
|---|---|---|---|---|---|---|---|
| 16 | INVENTIVE | 1245 | 1100 | 52 | 8.6 | 3.4 | 0.0003 |
| 17 | STEEL | 1230 | 1080 | 52 | 5.2 | 4.2 | 0.0004 |
| 18 | | 1425 | 1310 | 45 | 8.2 | 2.7 | 0.0002 |
| 19 | | 1426 | 1200 | 45 | 4.9 | 2.4 | 0.0012 |
| 20 | | 1350 | 1175 | 50 | 4.8 | 4.7 | 0.0009 |
| 21 | | 1446 | 1205 | 46 | 4.2 | 1.3 | 0.0004 |
| 22 | | 1545 | 1320 | 40 | 7.2 | 1.1 | 0.0002 |
| 23 | | 1590 | 1460 | 39 | 3.2 | 2.2 | 0.0008 |
| 24 | | 1514 | 1300 | 42 | 3.9 | 1.9 | 0.0002 |
| 25 | | 1462 | 1200 | 45 | 4.6 | 2.6 | 0.0003 |
| 26 | | 1420 | 1180 | 45 | 4.8 | 3.5 | 0.0003 |
| 27 | | 1375 | 1040 | 44 | 11.2 | 2.8 | 0.0004 |
| 28 | | 1245 | 1105 | 53 | 8.2 | 2.3 | 0.0008 |
| 29 | | 1365 | 1090 | 46 | 7.6 | 3.1 | 0.0009 |
| 30 | | 1436 | 1180 | 45 | 7.1 | 1.7 | 0.0003 |
| 44 | COMPARATIVE | 1090 | 1067 | 45 | 24.5 | 5.5 | 0.0004 |
| 45 | STEEL | 1465 | 1295 | 36 | 3.2 | 6.8 | 0.0023 |
| 46 | | 1532 | 1190 | 29 | 13.9 | 9.6 | 0.0003 |
| 47 | | 1345 | 1315 | 38 | 4.8 | 4.1 | 0.0004 |
| 48 | | 1475 | 1310 | 33 | 13.4 | 6.8 | <0.0002 |
| 49 | | 1380 | 1200 | 41 | 58.9 | 36.2 | 0.0004 |
| 50 | | 1320 | 1080 | 39 | 21.6 | 6.8 | <0.0002 |
| 51 | | 1598 | 1450 | 30 | 15.6 | 6.9 | <0.0002 |
| 52 | | 1320 | 1030 | 39 | 16.8 | 5.6 | <0.0002 |
| 53 | | 1426 | 1200 | 38 | 12.3 | 6.7 | <0.0002 |
| 54 | | 1446 | 1185 | 37 | 14.3 | 5.8 | <0.0002 |
| 55 | | 1620 | 1525 | 28 | 11.2 | 9.8 | — |

In Tables 1, numbers 1 to 15 correspond to the high strength wire rod according to the present invention and numbers 31 to 43 correspond to the conventional wire rod (Comparative Steel).

Figure 3:
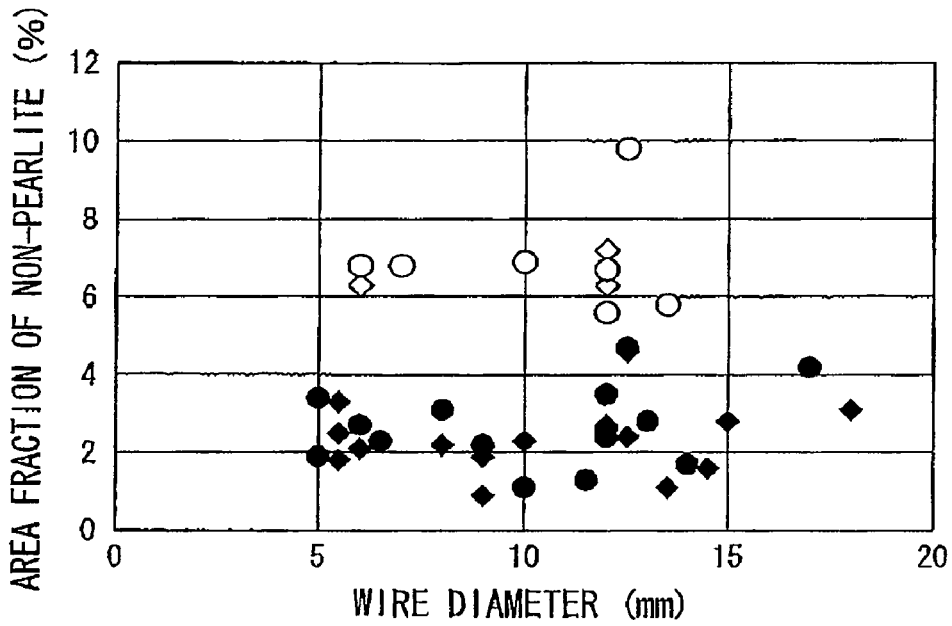
FIG. 3 is a graph showing a relation between a diameter of a wire rod and an area fraction of a non-pearlite structure in a section extending from the surface of the wire rod to the central portion thereof for each of wire rods after patenting treatments. In high strength wire rods according to the present invention denoted by solid diamonds ♦ showing values in Table 2 and solid circles ● showing values in Table 4, each of the wire rods has an area fraction of non-pearlite of 5% or less regardless of the wire diameter. While, in each of the conventional wire rods of Comparative Example denoted by open diamonds ◇ showing values in Table 2 and open circles ○ showing values in Table 4, an area fraction of non-pearlite is greater than 5%.

FIG. 3 is a graph showing a relation between a diameter of a wire rod and an area fraction of a non-pearlite structure in a section extending from the surface of the wire rod to the central portion thereof for each of wire rods after patenting treatments. The high strength wire rods of Table 2 according to the present invention which are denoted by a solid diamond symbol (♦) stably had an area fraction of non-pearlite of 5% or less regardless of the wire diameter. On the other hand, in each of the conventional high strength wire rods of Comparative Example in Table 2 which are denoted by the open diamond symbol (◇), an area fraction of a non-pearlite structure had a value greater than 5%.

Figure 4:
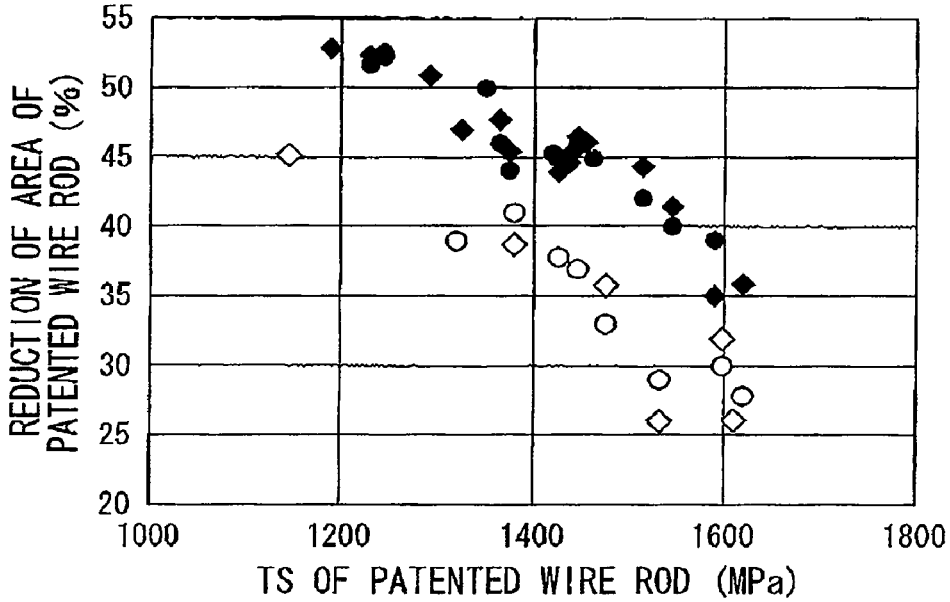
FIG. 4 is a graph showing a relation between a tensile strength TS and a reduction of area in wire rods after a patenting treatment. From the graph of FIG. 4, it is obvious that under the same tensile strength TS, the high strength wire rods of the present invention denoted by solid diamonds ♦ showing values in Table 2 and solid circles ● showing values in Table 4 respectively have a reduction of area that is superior to that of the conventional high strength wire rod of Comparative Example open diamonds ◇ showing values in Table 2 and open circles ○ showing values in Table 4.

Inventive Steel Numbers. 1 to 15 satisfied the requirements that the B content be in the range of 0.0004 to 0.0060% and that the time from finishing coiling to starting the patenting treatment be not greater than $t1=00013\times(Tr-815)^2+7\times(B\ content-0.0003)/(N\ content-Ti\ content/3.41-B\ content+0.0003)$. Therefore, it was possible to ensure the solid-solubilized B in an amount of 0.0002% or more, and the area fraction of the pro-eutectoid ferrite in the section ranging from the surface layer of the wire rod to the central portion thereof was 5% or less. FIG. 4 is a graph showing the relation between the tensile strength TS of the wire rod after the patenting treatment and the reduction of area. The solid diamonds ♦ denote Inventive Steels shown in Table 2 and the open diamonds ◇ denote the Comparative Steels shown in Table 2. From the graph, it can be understood that the reduction of area was improved in the wire rods developed according to the present invention.

The strength of the patented wire rod (strength of patented wire in Table 2) was also higher than the strength (TS threshold in Table 2) as specified by TS=(1000×C content (%)−10× wire-diameter (mm)+450).

In the wire rod of Inventive Steel 11, the temperature of salt was 505° C. Although the temperature was within the range of the present invention, because of the relatively low value, an area fraction of a non-pearlite structure exceeded 10%, resulting in occurrence of delamination after wire drawing. In Examples other than Inventive Steel 11, temperatures of lead or salt were not lower than 520° C. Therefore, the area fraction of the non-pearlite structure in the surface portion of each wire was suppressed to 10% or less.

On the other hand, in the wire rod of Comparative Steel No. 31, the temperature of coiling was as low as 750° C. and carbides of B were precipitated before the patenting treatment. Therefore, the non-pearlite structure could not be suppressed.

In the wire rod of Comparative Steel Nos. 32 and 37, the time from the finishing coiling to starting the patenting treatment was greater than $t1=0.0013\times(Tr-815)^2+7\times(B\ content-0.0003)/((N\ content-Ti\ content/3.41)\times0.71-B\ content+0.0003)$, and thus solid-solubilized B could not be retained and the occurrence of non-pearlite could not be suppressed.

In the wire rod of Comparative Steel No. 38 the temperature of molten lead was 450° C. Since the temperature was lower than the regulated value, occurrence of a non-pearlite structure could not be suppressed.

In the wire rod of Comparative Steel No. 38 the temperature of molten lead was 450° C. Since the temperature was lower than the regulated value, occurrence of a non-pearlite structure could not be suppressed.

It the wire rods of Comparative Steel Nos. 33 and 41, the B content was much higher than a predetermined amount, and thus carbides of B and pro-eutectoid cementite were precipitated.

In the wire rod of Comparative Steel No. 34, the Si content was too high at 1.6%, and thus the formation of a non-pearlite structure could not be suppressed.

In the wire rod of Comparative Steel No. 35, the C content was too high at 1.3%, and thus the precipitation of pro-eutectoid cementite could not be suppressed.

In the wire rod of Comparative Steel No. 36, the Mn content was too high at 1.5%, and thus the formation of micro-martensite could not be suppressed.

In the wire rods of Comparative Steels Nos. 39 and 40, the cooling rate during the patenting treatment was smaller than the regulated cooling rate, and thus a tensile strength and a tensile strength after the drawing process could not be satisfied in a predetermined LP (lead patented) steel.

In the wire rods of Comparative Steel Nos. 42 and 43, the B content was lower than a specified amount, and thus the formation of a non-pearlite structure could not be suppressed. The area fraction was greater than 5%.

In Tables 3 and 4, numbers 16 to 30 correspond to the high strength wire rods according to the present invention (Inventive Steel) and numbers 45 to 55 correspond to the conventional wire rods (Comparative Steel).

FIG. 3 is a graph showing a relation between a diameter of a wire rod and an area fraction of a non-pearlite structure in a section extending from the surface of the wire rod to the central portion thereof for each of wire rods after patenting treatments. Each of the high strength wire rods according to the present invention in Table 4 which are denoted by the solid circles (●) stably had an area fraction of pro-eutectoid ferrite of 5% or less regardless of the wire diameter. On the other hand, in each of the conventional high strength wire rods of Comparative Example in Table 4 which is denoted by open circles (o), the pro-eutectoid ferrite respectively had an area fraction greater than 5%.

Inventive Steel Numbers. 16 to 30 satisfied the requirements that the B content be in the range of 0.0004 to 0.0060% and that the time from finishing coiling to starting patenting treatment be not greater than $t1=0.0013\times(Tr-815)^2+7\times(B\ content-0.0003)/((N\ content-Ti\ content/3.41)\times0.71-B\ content+0.0003)$. Therefore, it was possible to ensure the solid-solibilized B in an amount of 0.0002% or more, and the area fraction of the non-pearlite structure in the section ranging from the surface layer of the wire rod to the central portion thereof was 5% or less. FIG. 4 shows a graph of a relation between tensile strength TS and reduction of area in the wire rods after the patenting treatment. The solid circle ● denotes Inventive Steels shown in Table 4 and the open circle ○ denotes Comparative Steels shown in Table 4. From the graph, it can be understood that the reduction of area was improved in the wire rods developed according to the present invention.

The strength of the patented wire rods (patented wire strength in Table 4) was also higher than the strength (TS threshold in Table 4) as specified by TS=(1000×C content (%)−10×wire diameter (mm)+450).

In the wire rod of Inventive Steel 27, the temperature of salt was 490° C. Although the temperature was within the range of the present invention, because of the relatively low value, an area fraction of a non-pearlite structure exceeded 10%, resulting in the occurrence of delamination after wire drawing. In Examples other than Inventive Steel 27, temperatures of lead or salt were not lower than 520° C. Therefore, area fraction of non-pearlite structure in the surface portion of each wire was suppressed to 10% or less.

On the other hand, in the wire rod of Comparative Steel No. 44, the coiling temperature was low at 750° C. and carbides of B were precipitated before the patenting treatment. Therefore, the formation of a non-pearlite structure could not be suppressed.

In the wire rods of Comparative Steel Numbers. 50, 52, 53, and 54, the time from finishing coiling to starting the patenting treatment was greater than $t1=0.0013\times(Tr-815)^2+7\times(B\ content-0.0003)/((N\ content-Ti\ content/3.41)\times0.71-B\ content+0.0003)$, and thus it was difficult to retain the solid-solubilized B. Therefore, the formation of the non-pearlite structure could not be suppressed.

In the wire rod of Comparative Steel No. 49, the temperature of molten lead during the patenting process was 450° C. Since the temperature was lower than the regulated value, the occurrence of a non-pearlite structure could not be suppressed.

In the wire rod of Comparative Steel No. 45, the B content was much higher than a predetermined amount, and thus carbides of B and the pro-eutectoid cementites were precipitated.

In the wire rod of Comparative Steel No. 46, the Si content was too high at 1.6%, and thus the formation of the non-pearlite structure could not be suppressed.

In the wire rods of Comparative Steel No. 47, the Mn content was too high at 1.5%, and the formation of the micro-martensites could not be suppressed.

In the wire rod of Comparative Steel Nos. 48, 51, and 55, the B content was lower than a specified amount, and thus it was difficult to suppress the formation of a non-pearlite structure. The area fraction was 5% or more.

Test steel wires for PWS having a diameter of 5.2 mm were, produced using Inventive Steel Numbers 19, 21, and 26 prepared in the Example. It was possible to produce delamination-free steel wires respectively having a tensile, strength TS of 2069 MPa, 2060 MPa, and 2040 MPa. On the other hand, when a test steel wire of similar configuration was produced using Inventive Steel No. 27, the tensile strength TS was 1897 MPa, and, although delamination did not occur, number of breaking torsion decreased by about 30% compared to the above-described three cases. The same test Wire was produced using Comparative Steel No. 52. In this case, the tensile strength TS was 1830 MPa, and delamination occurred.

INDUSTRIAL APPLICABILITY

In the present invention having the above-described configuration, by specifying the component composition of the steel wire used and including solid-solubilized B in an amount corresponding to the content of C and Si in austenite before subjecting to a patenting treatment, it is possible to provide a balanced delving force to the cementite precipitation and the ferrite precipitation. A hard steel wire can be obtained having a structure mainly composed of pearlites wherein the area fraction of a non-pearlite structure is 5% or less. Accordingly, it is possible to improve performance when used for PC steel wires, galvanized stranded steel wires, spring steel wires, suspension bridge cables and the like.

The invention claimed is:

1. A high strength wire rod having a high reduction of area, comprising:

in mass %, C: 0.7 to 1.2%, Si: 0.35 to 1.5%, Mn: 0.1 to 1.0%, N: 0.001 to 0.006%, Al: 0.005 to 0.1%, B: 0.0004 to 0.0060%, wherein a solid-solubilized amount of B is approximately, by mass %, at least 0.0002%, and the balance consisting of Fe and unavoidable impurities, wherein a tensile strength (MPa) of the wire rod is specified by the following formula, $$TS \geqq [1000\times C\ content\ (\%)-10\times wire\ rod\text{-}diameter\ (mm)+450],$$

wherein the reduction of area after breaking of the wire rod is 35% or more with the tensile strength of the wire rod of 1190 MPa or more, wherein, in a surface portion from a surface to a depth of 100 μm of the wire rod, an area fraction of a non-pearlite structure is present in the wire rod and is at most 10%, and the balance is composed of a pearlite structure, wherein in a section from the surface to a central portion of the wire rod, an area fraction of a non-pearlite structure is present in the wire rod and is at most 5%, and the balance is composed of a pearlite structure, wherein a diameter of the wire rod is 5.0 mm to 18.0 mm, and wherein the non-pearlite structure is composed of at least one of a pro-eutectoid ferrite, a degenerate-pearlite, or a bainite generating along grain boundaries of a prior austenite.

2. The high strength wire rod according to claim 1, further comprising, by mass %, at least one of Cr: 0.5% or less (and excluding 0%), Ni: 0.5% or less (and excluding 0%), Co: 0.5% or less (and excluding 0%), V: 0.5% or less (and excluding 0%), Cu: 0.2% or less (and excluding 0%), Mo: 0.2% or less (and excluding 0%), W: 0.2% or less (and excluding 0%), or Nb: 0.1% or less (and excluding 0%).

3. A high strength wire rod having a high reduction of area, comprising:

in mass %, C: 0.7 to 1.2%, Si: 0.35 to 1.5%, Mn: 0.1 to 1.0%, N: 0.001 to 0.006%, Ti: 0.005 to 0.1%, B: 0.0004 to 0.0060%, wherein a solid-solubilized amount of B is approximately, by mass %, at least 0.0002%, and the balance consisting of Fe and unavoidable impurities, wherein a tensile strength (MPa) of the wire rod is specified by the following formula, $$TS \geqq [1000 \times C\ content\ (\%) - 10 \times wire\ rod\text{-}diameter\ (mm) + 450],$$

wherein the reduction of area after breaking of the wire rod is 35% or more with the tensile strength of the wire rod of 1190 MPa or more, wherein, in a surface portion from a surface to a depth of 100 μm of the wire rod, an area fraction of a non-pearlite structure is present in the wire rod and is at most 10%, and the balance is composed of a pearlite structure, wherein in a section from the surface to a central portion of the wire rod, an area fraction of a non-pearlite structure is present in the wire rod and is at most 5%, and the balance is composed of a pearlite structure, wherein a diameter of the wire rod is 5.0 mm to 18.0 mm, and wherein the non-pearlite structure is composed of at least one of a pro-eutectoid ferrite, a degenerate-pearlite, or a bainite generating along grain boundaries of a prior austenite.

4. The high strength wire rod according to claim 3, further comprising, by mass %, Al: 0.1% or less.

5. The high strength wire rod according to claim 4, further comprising, by mass %, at least one of Cr: 0.5% or less (and excluding 0%), Ni: 0.5 or less (and excluding 0%), Co: 0.5% or less (and excluding 0%), V: 0.5% or less (and excluding 0%), Cu: 0.2% or less (and excluding 0%), Mo: 0.2% or less (and excluding 0%), W: 0.2% or less (and excluding 0%), or Nb: 0.1% or less (and excluding 0%).

6. The high strength wire rod according to claim 3, further comprising, by mass %, at least one of Cr: 0.5% or less (and excluding 0%), Ni: 0.5 or less (and excluding 0%), Co: 0.5% or less (and excluding 0%), V: 0.5% or less (and excluding 0%), Cu: 0.2% or less (and excluding 0%), Mo: 0.2% or less (and excluding 0%), W: 0.2% or less (and excluding 0%), or Nb: 0.1% or less (and excluding 0%).

7. The high strength wire rod according to claim 1, wherein the reduction of area after breaking of the wire rod is 44% or more with the tensile strength of the wire rod of 1230 MPa or more.

8. The high strength wire rod according to claim 3, wherein the reduction of area after breaking of the wire rod is 44% or more with the tensile strength of the wire rod of 1230 MPa or more.

9. The high strength wire rod according to claim 1, wherein, in the surface portion from the surface to the depth of 100 μm of the wire rod, the area fraction of the non-pearlite structure is approximately at least 0.9%.

10. The high strength wire rod according to claim 3, wherein, in the surface portion from the surface to the depth of 100 μm of the wire rod, the area fraction of the non-pearlite structure is approximately at least 0.9%.

* * * * *